United States Patent [19]

Fox

[11] Patent Number: 4,595,233

[45] Date of Patent: Jun. 17, 1986

[54] ACTUATING SHAFT ASSEMBLY

[76] Inventor: Charles S. Fox, 8516 Dogwood, Germantown, Tenn. 38138

[21] Appl. No.: 621,941

[22] Filed: Jun. 18, 1984

[51] Int. Cl.[4] ..... A47C 1/034; A47B 95/02; G05G 1/04

[52] U.S. Cl. ..... 297/69; 16/115; 74/545; 297/85; 403/3

[58] Field of Search ..... 297/85, 69, 70, 89, 297/107, 68, 84; 74/544, 545, 546, 547, 525; 16/114 R, 115, DIG. 41; 403/3, 4, 379, 108

[56] References Cited

U.S. PATENT DOCUMENTS

| | | | |
|---|---|---|---|
| 1,146,054 | 7/1915 | Curry | 74/545 |
| 1,193,126 | 8/1916 | Cumings | 74/547 |
| 2,853,897 | 9/1958 | Loewy | 74/544 |
| 3,099,487 | 7/1963 | Knabusch et al. | 297/69 |
| 3,467,415 | 9/1969 | Sandor | 403/3 X |
| 3,475,051 | 10/1969 | Crawford | 297/85 |
| 3,484,132 | 12/1969 | Biagi | 297/69 |
| 3,484,133 | 12/1969 | White et al. | 297/69 |
| 4,108,491 | 8/1978 | Rogers, Jr. | 297/85 |

*Primary Examiner*—William E. Lyddane
*Assistant Examiner*—Mark W. Binder
*Attorney, Agent, or Firm*—Walker & McKenzie

[57] ABSTRACT

An actuating shaft assembly for use with recliner-type chairs including a footrest and a carriage assembly for moving the footrest between extended and retracted positions. The actuating shaft assembly includes a first shaft member coupled to the carriage assembly, a second shaft member telescopically coupled to the first shaft member for adjustment relative thereto to accomodate chairs having different side wall thicknesses, bolts or the like to fixedly attach the first and second shaft members to one another, and a handle attached to the outer end of the second shaft member for allowing the shaft members to be manually rotated to move the carriage assembly and footrest between the extended and retracted positions. The actuating shaft assembly includes a first shaft member coupled to the carriage assembly, a second shaft member telescopically coupled to the first shaft member for adjustment relative thereto to accomodate chairs having different sidewall thicknesses, bolts or the like to fixedly attach the first and second shaft members to one another, and a handle attached to the outer end of the second shaft member for allowing the shaft members to be manually rotated to move the carriage assembly and footrest between the extended and retracted positions.

5 Claims, 7 Drawing Figures

ACTUATING SHAFT ASSEMBLY

BACKGROUND OF THE INVENTION

1. Field of the Invention

The present invention relates, in general, to an improved actuating shaft assembly for use with recliner-type chairs having a footrest movable between extended and retracted positions.

2. Description of the Prior Art

Various recliner-type chairs have been developed and are marketed under such trademarks as "La-Z-Boy", "Stratolounger", and the like. Such chairs include a footrest and a carriage mechanism for movement between extended and retracted positions and for supporting the footrest in the extended and retracted positions. An actuating shaft assembly is typically coupled to the carriage mechanism for allowing the user of the chair to manually move the carriage mechanism and footrest between the extended and retracted positions with the aid of an operating arm or handle. Knabusch, U.S. Pat. No. 3,099,487 discloses a typical chair of the above-described type including a one-piece actuating shaft 58 extending between the sidewalls of the chair and rotatably carried by bushings 60 in the sidewalls of the chair. An operating arm 62 is attached to one end of the actuating shaft 58 to allow the user of the chair to manually rotate the actuating shaft 58. Pantograph mechanisms 36, 38 are coupled to the actuating shaft 58 and to the foot or leg rest member 34 whereby rotation of the actuating shaft 58 will cause the pantograph mechanisms 36, 38 to move between extended and retracted positions. The following patents were discovered by a preliminary patentability search: Cumings, U.S. Pat. No. 1,193,126; Nixon, U.S. Pat. No. 1,828,980; Vigot, U.S. Pat. No. 3,503,276; Benoit, U.S. Pat. No. 3,771,385 and Knoke, U.S. Pat. No. 4,192,028. None of the above patents disclose or suggest the present invention.

SUMMARY OF THE INVENTION

The present invention is directed toward providing an improved actuating shaft assembly for use with chairs of the type including a footrest and a carriage mechanism for movement between extended and retracted positions. The concept of the present invention is to provide an actuating shaft assembly which allows minute adjustments in the length thereof to accommodate chairs having varying sidewall thicknesses due to upholstery and the like.

The actuating shaft assembly of the present invention comprises, in general, a first shaft means having a fixed length for being coupled to the carriage mechanism of a chair of the type including a footrest and a carriage mechanism for movement between extended and retracted positions, rotation of the first shaft means causing the carriage mechanism to move between the extended and retracted positions; a second shaft means having a first end for being telescopically coupled to the first shaft means and having a second end; attachment means for fixedly attaching the first end of the second shaft means to the first shaft means; and a handle member for being attached to the second end of the second shaft member and for allowing the first and second shaft means to be manually rotated to cause the carriage mechanism to move between the extended and retracted positions.

DESCRIPTION OF THE PREFERRED EMBODIMENT

Figure 6:
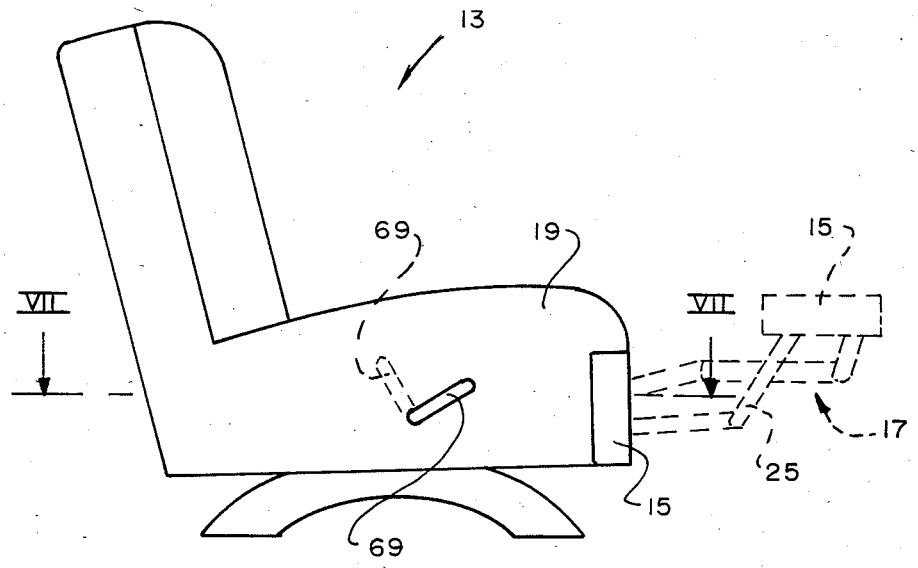
FIG. 6 is a side elevational view of a recliner-type chair showing a portion thereof in a moved position in broken lines.
Figure 7:
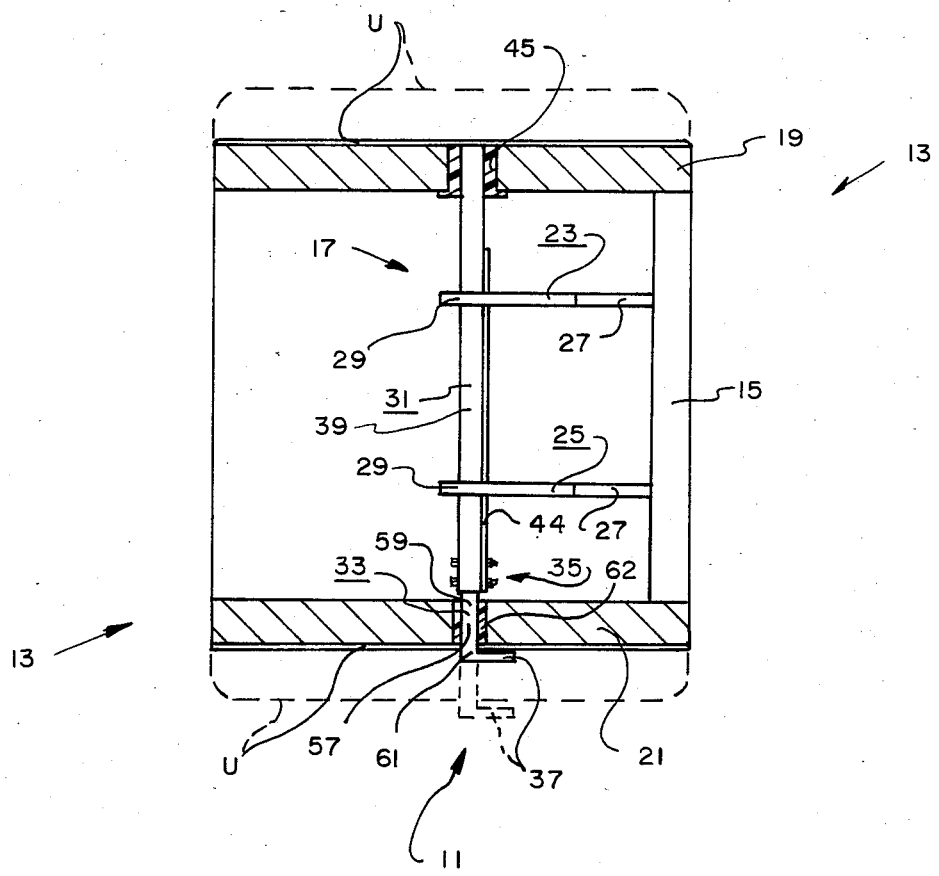
FIG. 7 is a sectional view substantially as taken on line VII—VII of FIG. 6 and showing the actuating shaft assembly of the present invention with certain structure shown in broken lines to represent alternate configurations.

The actuating shaft assembly 11 of the present invention is for use with a chair 13 of the type including a footrest 15 and carriage mechanism 17 for movement between extended and retracted positions and for supporting the footrest 15 in the extended and retracted positions (see, in general, FIGS. 6 and 7). The chair 13 includes a first sidewall 19 and a second sidewall 21. The specific thickness of the first and second sidewalls 19, 21 and overall width of the chair 13 will vary according to the type of upholstery U used, etc. as indicated in FIG. 7. The carriage mechanism 17 preferably includes a pair of spaced-apart pantograph members 23, 25. Each pantograph member 23, 25 has a first end 27 for being attached to the footrest 17 and a second end 29 for being coupled to the actuating shaft assembly 11 whereby rotation of the actuating shaft 11 will cause the pantograph members 23, 25 to extend and retract and to cause the footrest 15 to move between the extended and retracted positions in a manner as will be apparent to those skilled in the art.

The actuating shaft assembly 11 includes, in general, a first shaft means 31 for being coupled to the carriage mechanism 17; a second shaft means 33 for being telescopically coupled to the first shaft means 31; attachment means 35 for fixedly attaching the first and second means 31, 33 to one another; and a handle member 37 for being attached to the second shaft means 33 and for allowing the first and second shaft means 31, 33 to be manually rotated to cause the carriage mechanism 17 to move between the extended and retracted positions.

Figure 1:
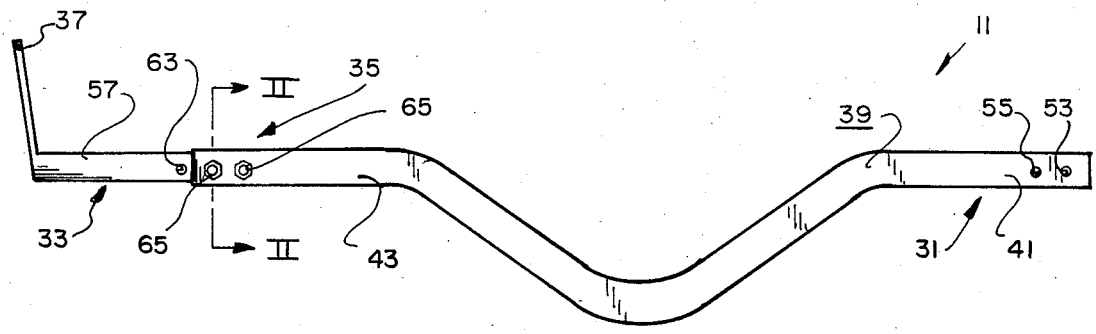
FIG. 1 is a front elevational view of the actuating shaft assembly of the present invention.
Figure 2:
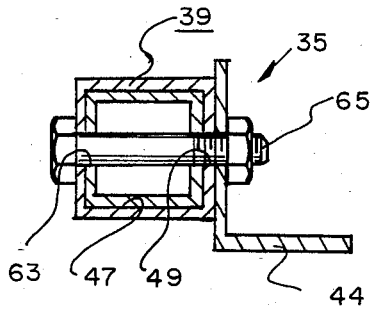
FIG. 2 is an enlarged sectional view substantially as taken on line II—II of FIG. 1 with certain structure of a recliner-type chair attached thereto.
Figure 3:
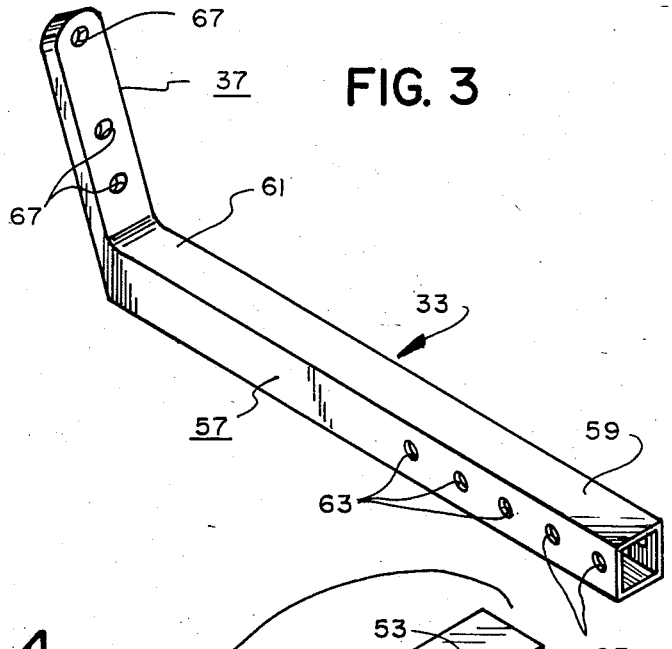
FIG. 3 is a perspective view of a second shaft means of the actuating shaft assembly of the present invention.
Figure 4:
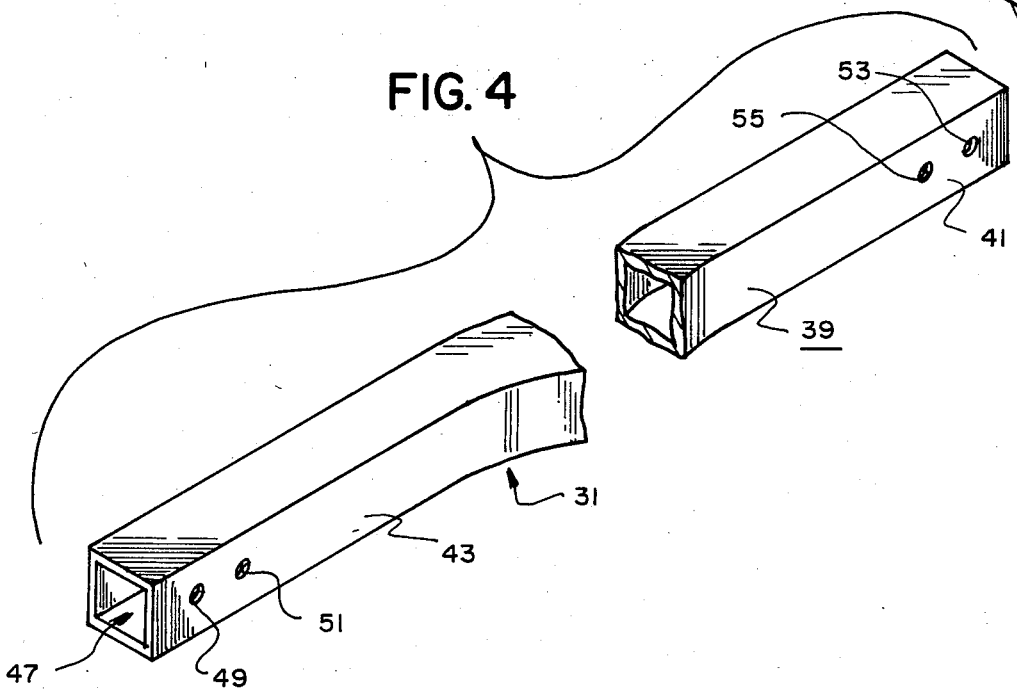
FIG. 4 is a perspective view of a first shaft means of the actuating shaft assembly of the present invention with portions thereof broken away for clarity.

The first shaft means 31 preferably includes an elongated shaft member 39 having a fixed length for being coupled to the carriage mechanism 17 in such a manner that rotation thereof will cause the carriage mechanism to move between the extended and retracted positions. The shaft member 39 has a first end 41 and a second end 43. The shaft member 39 preferably extends between and is operably coupled to the second ends 29 of the pair of pantograph members 23, 25 in any manner as will now be apparent to those skilled in the art. Thus, for example, an attaching bracket 44 at the second end 29 of the pair of pantograph members 23, 25 may be bolted to the shaft member 39 (see, in general, FIGS. 2 and 7). The first end 41 of the shaft member 39 is preferably rotatably mounted with respect to the first sidewall 19 of the chair 13 in any manner now apparent to those skilled in the art. For example, the first sidewall 19 may be provided with a bushing 45 and the first end 41 of the shaft member 39 may be rotatably carried by the bushing 45. The second end 43 of the shaft member 39 preferably has a longitudinal cavity 47 therein for coacting with the second shaft means 33 in a manner which will hereinafter become apparent. The shaft member 39 may be constructed of metal tubing, or the like, and may have a square, round or rectangular cross section or the like, whereby the longitudinal cavity 47 may extend completely between the first and second ends 41, 43 thereof. The second end 43 of the shaft member 39 preferably has at least one and preferably a pair of spaced-apart, transverse apertures 49, 51 therethrough for reasons which will hereinafter become apparent. The first end 41 of the shaft member 39 may also be provided with a pair of spaced-apart, transverse apertures 53, 55 therethrough for reasons which will hereinafter become apparent. The shaft member 39 may be straight or may have a V-shaped curve between the ends 41, 43 as clearly shown in FIG. 1 to accommodate certain structure of the chair 13 as will be apparent to those skilled in the art.

The second shaft means 33 preferably includes a shaft member 57 having a first end 59 for being telescopically coupled to the second end 43 of the shaft member 39 and having a second end 61 for being attached to the handle member 37. The first end 59 preferably has a cross-sectional shape that corresponds to that of the shaft member 39 and is preferably sized so as to slidably fit within the longitudinal cavity 47 in the second end 43 of the shaft member 39, thus allowing the effective length of the first and second shaft means 31, 33 to be varied by slidably moving the second shaft means 33 within the first shaft means 31 for reasons which will hereinafter become apparent with the shaft member 57 extending through an opening or bushing 62 in the second side wall 21 of the chair 13 to position the first end 59 inside the chair 13 and to position the second end 61 outside the chair 13 as clearly shown in FIG. 7. The first end 59 of the shaft member 57 has at least one and preferably a plurality of spaced-apart, transverse apertures 63 therethrough for coacting with the transverse apertures 49, 51 of the second end 43 of the shaft member 49 and with the attachment means 35 to a11ow the first and second shaft means 31, 33 to be fixedly attached to one another. Thus, the attachment means 35 may include at least one and preferably a pair of bolt means 65 for extending through the transverse apertures 19, 51 and an aligned pair of the transverse apertures 63 to fixedly attach the second end 43 of the shaft member 39 and the first end 59 of the shaft member 57 to one another. The bolt means 65 may be used to attach the attaching bracket 44 of the carriage mechanism 17 to the shaft assembly 11 and may be of any typical construction well-known to those skilled in the art including a bolt member and a coacting nut member or the like. The transverse apertures 33, 55 through the first end 41 of the shaft member 39 allow the shaft member 57 to be attached to either end of the shaft member 39 as will now be apparent to those skilled in the art.

The handle member 37 may consist of a separate arm member fixedly attached to the second end 61 of the shaft member 57. However, the shaft member 57 preferably consists of simply an elongated, hollow metal tube being substantially square in cross-section and the handle member 37 may consist of an elongated metal bar fixedly attached in any manner, such as by being welded at a substantially right angle to or integrally formed at a substantially right angle with the second end 61 of the shaft member 57. The handle member 37 may have one or more apertures 67 therethrough for allowing a decorative arm member 69 or the like to be attached thereto by way of screws or the like.

Figure 5:
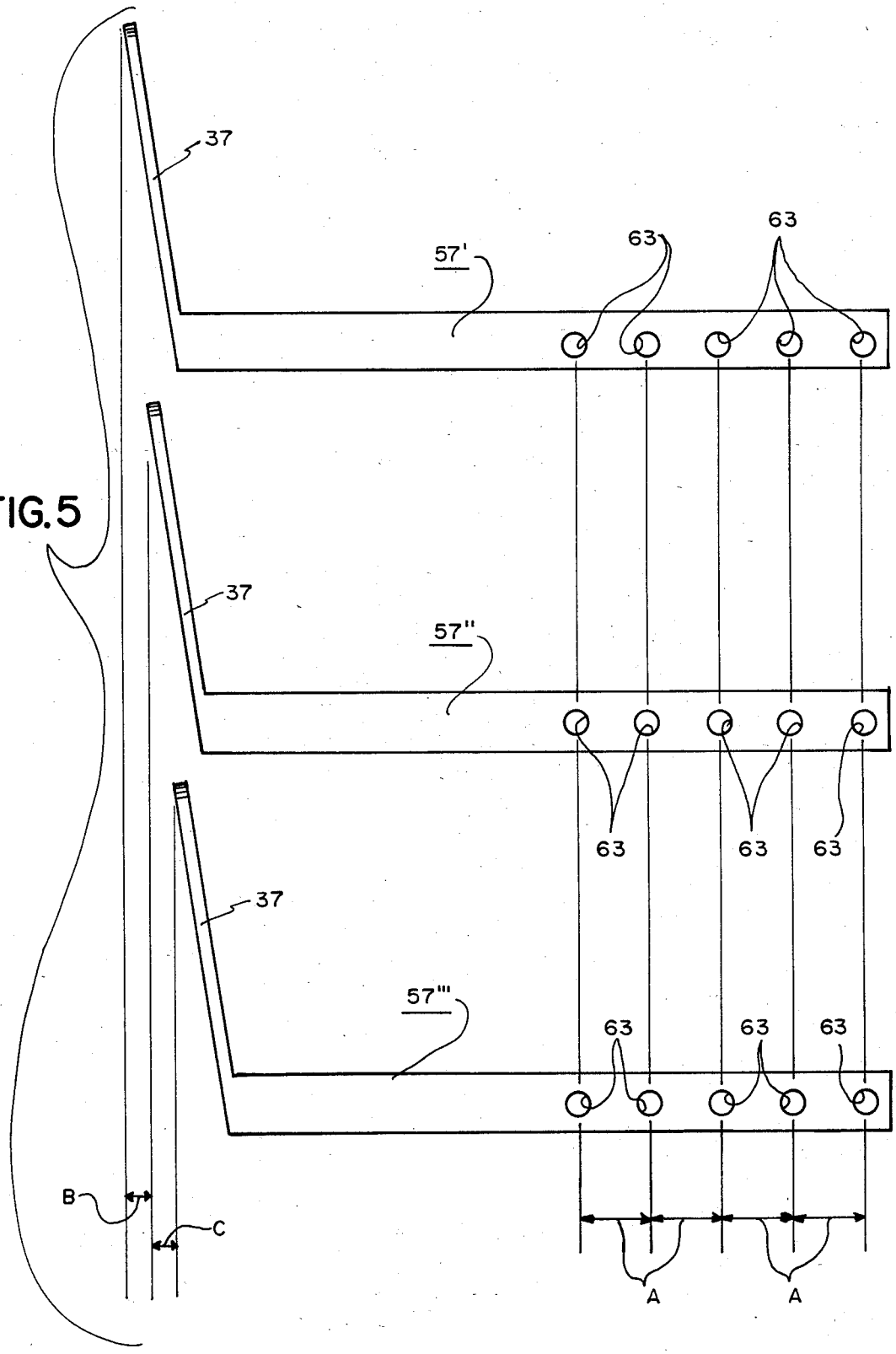
FIG. 5 is a somewhat diagrammatic view of a plurality of shaft members of the second shaft means.

A unique feature of the actuating shaft assembly 11 is the minute adjustment provided thereby to accommodate chairs 13 having different sidewall thicknesses and overall widths and the like. More specifically, most manufacturers of reclinertype chairs will have a line of chairs having sidewall thicknesses that vary considerably due to different upholstery U and the like being applied to the sidewalls 19, 21 while the inside distance between the sidewalls 19, 21 remain substantially constant and while the distance between the pantograph members 23, 25 remain substantially constant. The plurality of transverse apertures 63 through the first end 59 of the shaft member 57 allows the effective length of the first and second shaft means 31, 33 to be varied as will now be apparent to those skilled in the art by increments equal to the distance "A" between two adjacent apertures 63 (see FIG. 5) whereby the handle member 37 can be located a substantially constant distance from the outer surface of the second sidewall 21 of the chairs 13 (including any upholstery U thereon) regardless of the specific thickness of the sidewall 21. The second shaft means 33 may include a plurality of shaft members 57 as shown in FIG. 5 with each shaft member 57 having a different overall length. Thus, for example, the second shaft means 33 may include a first shaft member 57' having an overall length of, for example, eight inches (203.2 mm), may include a second shaft member 57'' having an overall length of, for example, seven and three-quarters inches (196.85 mm), and may include a third shaft member 57''' having an overall length of, for example, seven and one-half inches (190.5 mm), thus allowing the actuating shaft assembly 11 to be adjusted in one-fourth inch (6.35 mm) increments even though the distance "A" between each aperture 63 for all three shaft members 57', 57'', 57'' may be greater than one-fourth inch. Thus, for example, the distance "A" may be three-fourths of an inch (19.05 mm) while the difference "B" between the first and second shaft members 57', 57'' and the difference "C" between the second and third shaft members 57'', 57''' as shown in FIG. 5 is one-fourth inch (6.35 mm).

As thus used and constructed, the actuating shaft assembly 11 allows the effective length thereof to be varied in relatively small increments to accommodate chairs 13 of varying overall widths while allowing the actuating handle member 37 to be located at a substantially constant distance from the outer surface of the upholstery U regardless of the thickness of the upholstery U or overall width of the chair 13 as clearly indicated in FIG. 7.

Although the invention has been described and illustrated with respect to a preferred embodiment thereof and a preferred use therefore, it is not to be so limited since changes and modifications can be made therein which are within the full intended scope of the invention.

I claim:

1. An actuating shaft assembly for use with a chair of the type including a first sidewall, a second sidewall, a footrest and a carriage mechanism for movement between extended and retracted positions and for supporting said footrest in said extended and retracted positions, said assembly comprising:

(a) first shaft means coupled to said carriage mechanism for causing said carriage mechanism to move between said extended and retracted positions when rotated, said first shaft means including a shaft member having first and second ends with said first end being rotatably mounted to said first sidewall of said chair and with said second end having at least one transverse aperture therethrough;

(b) second shaft means including a plurality of shaft members of varying lengths with each of said shaft members having first and second ends and with said first end of one of said shaft members extending through said second sidewall of said chair and being telescopically attached to said second end of said shaft member of said first shaft members for allowing said second end of said one of said shaft members of said second shaft means to be positioned a substantially constant distance outward of said second sidewall of said chair regardless of the width of said chair, said first end of each of said shaft members of said second shaft means having a plurality of spaced apart transverse apertures therethrough, the spacing of said apertures through said first end of each of said shaft members of said second shaft means being the same for all of said shaft members of said second shaft means and being greater than the variance in length between each of said shaft members of said second shaft means;

(c) attachment means extending through at least one of said transverse apertures through said first end of said one of said shaft members of said second shaft means that extends through said second sidewall of said chair and extending through said at least one transverse aperture through said second end of said shaft member of said first shaft means and fixedly attaching said shaft members together; and (d) handle means coupled to said second end of said one of said shaft members of said second shaft means that extends through said second sidewall of said chair for allowing the manual rotation thereof to cause said shaft member of said first shaft means to rotate and to cause said carriage mechanism to move between said extended and retracted positions.

2. The actuating shaft assembly of claim 1 in which said second end of said shaft member of said first shaft means has a pair of spaced apart, transverse apertures therethrough; and in which said attachment means includes a pair of bolt means for passing through said apertures through said second end of said shaft member of said first shaft means and through a pair of said apertures through said first end of said one of said shaft members of said second shaft means.

3. The actuating shaft assembly of claim 2 in which said carriage mechanism includes a pair of spaced apart pantograph members, each pantograph member having a first end and a second end, said first ends of said pantograph members being attached to said footrest, said second ends of said pantograph members being coupled to said first shaft means, rotation of said first shaft means causing said pantograph members to extend and retract to cause said footrest to move between said extended and retracted positions.

4. The actuating shaft assembly of claim 3 in which said pantograph members are spaced apart a constant distance for chairs of varying widths.

5. The actuating shaft mechanism of claim 2 in which said second end of said shaft member of said first shaft means has a longitudinal cavity therein for telescopically receiving said first end of said one of said shaft members of said second shaft means.

* * * * *